United States Patent [19]

Coleman et al.

[11] 4,293,122

[45] Oct. 6, 1981

[54] PIPE RAILING SYSTEM

[76] Inventors: William J. Coleman, 645 Louden Ave., Dunedin, Fla. 33528; Jay Logue, 2339 Orangeside Rd., Palm Harbor, Fla. 33563

[21] Appl. No.: 48,262

[22] Filed: Jun. 13, 1979

[51] Int. Cl.[3] ..... E04H 17/14

[52] U.S. Cl. ..... 256/69; 256/21

[58] Field of Search ..... 256/65, 69, 59, 21, 256/22; 52/731, 738

[56] References Cited

U.S. PATENT DOCUMENTS

| | | | |
|---|---|---|---|
| 3,276,182 | 10/1966 | Handley | 52/731 |
| 3,349,538 | 10/1967 | Crossman | 256/59 X |
| 3,858,850 | 11/1975 | Maxcy | 256/22 |
| 3,918,686 | 11/1975 | Knott | 256/22 X |
| 4,050,828 | 9/1977 | Noro | 256/22 X |

*Primary Examiner*—Andrew V. Kundrat

*Attorney, Agent, or Firm*—Stanley M. Miller

[57] ABSTRACT

An improved pipe railing system is disclosed which employs a pair of basic structural parts which may be joined by means of a unique, integral fastening mechanism to form uniform horizontal pipe railings and vertical pipe posts which may be mechanically joined without the need for welding or industrial adhesives. The improved pipe railing structure is a pair of half-cylindrical hollow body members which each have first and second terminal edges with longitudinal fasteners for joining the two halves. A unique fastener anchorage member is disposed along the inner surface of each body member, having a longitudinal recess therein, for receiving and anchoring a fastener in the axial direction. In this manner, the lower body member of a top horizontal railing may be fastened to a vertical post made up of two such body members by means of simple screw fasteners, followed by mechanically snapping an upper cylindrical body member to the lower cylindrical body member thereby completing the top horizontal railing. The resulting pipe railing system provides an aesthetically pleasing, structurally rigid barrier which is inexpensive to produce and easy to install.

10 Claims, 5 Drawing Figures

SEC. 4-4'

FIG. 3
SEC. 3-3'
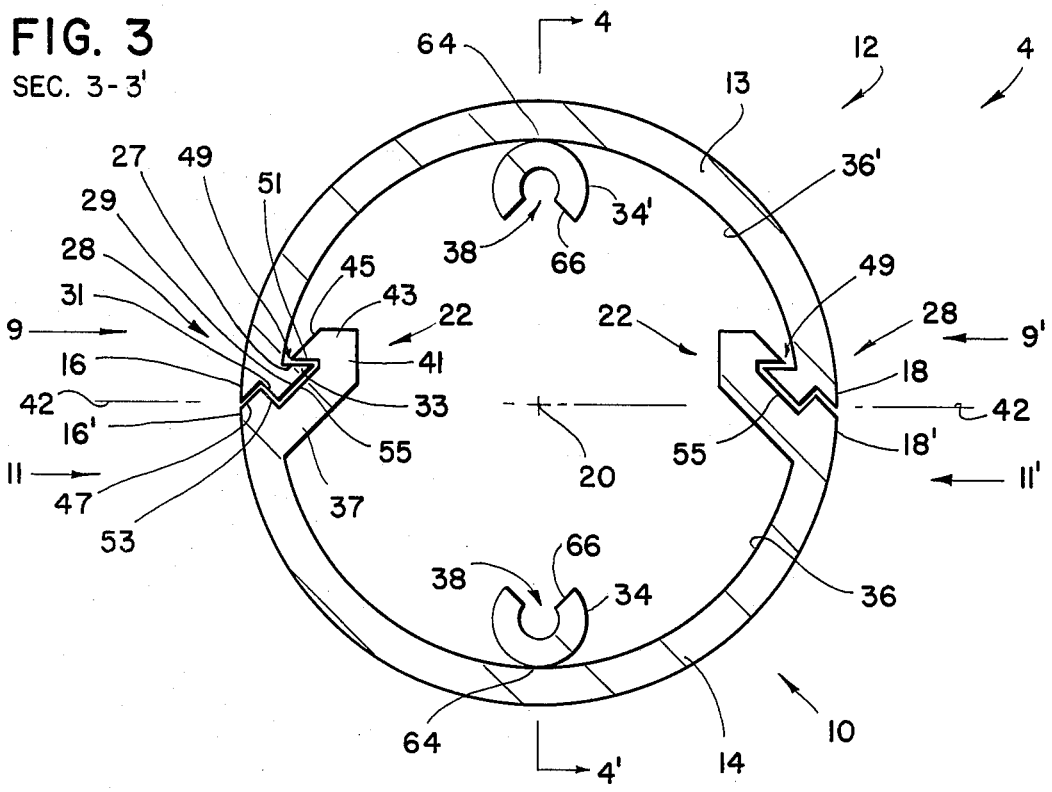
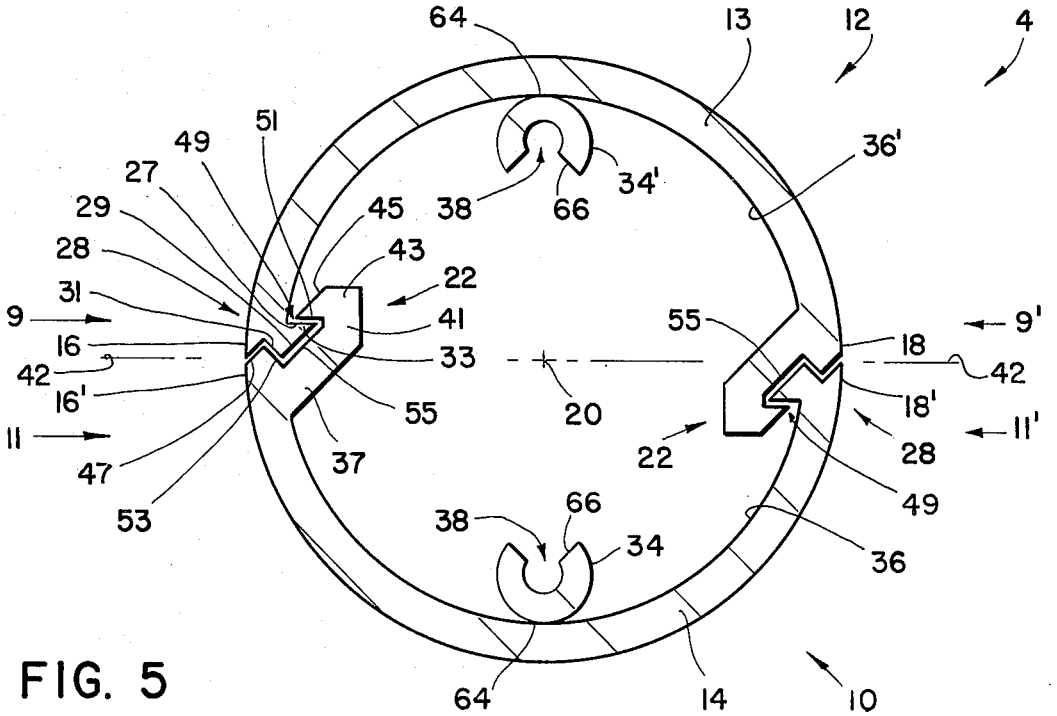
FIG. 5

PIPE RAILING SYSTEM

FIELD OF THE INVENTION

The invention disclosed is broadly related to railing structures and more particularly is directed to an improved pipe railing system.

BACKGROUND OF THE INVENTION

Railings and bannisters are common architectural features which serve as barriers at the edge of elevated platforms. Modern pipe railing structures require a special expertise to install, generally requiring the services of a welder to join the vertical posts to the horizontal railing members. Recent improvements to hand rail and bannister systems have provided special mechanical fasteners which join the horizontal railings to the vertical posts. These prior art structures are made up of different types of railing, and post and fastener elements which require distinct manufacturing operations to produce.

OBJECTS OF THE INVENTION

It is therefore an object of the invention to provide an improved pipe railing system.

It is yet another object of the invention to provide an improved pipe railing system which does not require welding or mechanical adhesives to install.

It is still a further object of the invention to provide an improved hand railing system made up of a minimum number of types of components, thereby having a reduced manufacturing cost.

SUMMARY OF THE INVENTION

These and other objects, features and advantages of the invention are provided by the improved pipe railing system disclosed herein. An improved pipe railing system is disclosed which employs a pair of basic structural parts which may be joined by means of a unique, intergral fastening mechanism to form uniform horizontal pipe railings and vertical pipe posts which may be mechanically joined without the need for welding or industrial adhesives. The improved pipe railing structure is a pair of half-cylindrical hollow body members which each have first and second terminal edges with longitudinal fasteners for joining the two halves. A unique fastener anchorage member is disposed along the inner surface of each body member, having a longitudinal recess therein, for receiving and anchoring a fastener in the axial direction. In this manner, the lower body member of a top horizontal railing may be fastened to a vertical post made up of two such body members by means of simple screw fasteners, followed by mechanically snapping an upper cylindrical body member to the lower cylindrical body member thereby completing the top horizontal railing. The resulting pipe railing system provides an aesthetically pleasing, structurally rigid barrier which is inexpensive to produce and easy to install. In an alternate embodiment, the structure of both halves of the pipe railing are identical. A first female type clamping member is displosed along the first terminal edge of the body member, having opposed clamping surfaces. A first male type fastening member is disposed along the second terminal edge of the body member, having a fastening surface which is complementary in shape to the opposed clamping surfaces of the female clamping member. The first male and first female members are capable of respectively fastening to second female and second male members, respectively, which are identical to the first female and first male members, disposed along a second half-cylindrical body member which is parallel with the axis and proximate to the first body member. A simple mechanical snapping action will join the first and second body members into a single, unitary pipe structure which may be used for horizontal pipe railings or vertical posts.

DESCRIPTION OF THE FIGURES

These and other objects, features and advantages of the invention will be more fully appreciated with reference to the accompanying figures.

FIG. 3 is a cross-sectional view along the section lines 3—3' of FIG. 2.

FIG. 5 shows an alternate embodiment of the invention.

DISCUSSION OF THE PREFERRED EMBODIMENT

Figure 1:
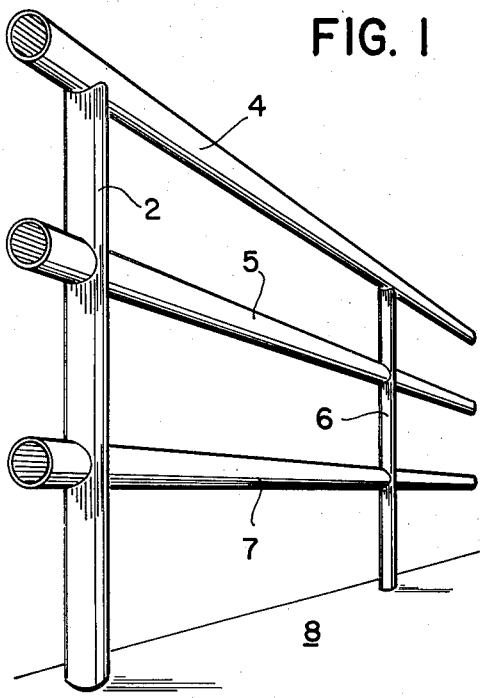
FIG. 1 is a perspective view of the improved pipe railing system disclosed herein.
Figure 2:
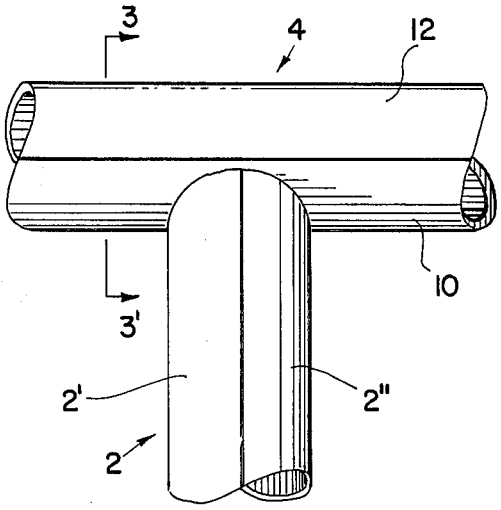
FIG. 2 is a frontal view of the improved pipe railing system disclosed herein.

A perspective view of the improved pipe railing system is shown in FIG. 1 wherein the vertical posts 2 and 6 are mounted in the floor 8 and support the top railing 4 and the intermediate horizontal railing 5 and 7. FIG. 2 is a frontal view of the improved pipe railing system of FIG. 1 showing in more detail the arrangement of the vertical post 2 and horizontal top railing 4. FIG. 3 is a cross-sectional view along section lines 3—3' of FIG. 2 showing a more detailed view of the preferred embodiment of the improved pipe railing structure.

The top horizontal railing 4 is actually made up of two cylindrical halves, a lower half 10 and an upper half 12, as shown in FIG. 3. The upper half-cylindrical, hollow body member 13 has a first terminal edge 16 and a second terminal edge 18 parallel with a cylindrical axis 20. The lower half-cylindrical, hollow body member 14 has a first terminal edge 16' and a second terminal edge 18' parallel with the axis 20.

A significant feature of the invention is the fastener anchorage member 34 which is disposed along the inner surface 36 of the lower body member 14, parallel with the axis 20. A longitudinal recess 38 in the fastener anchorage member 34 is parallel with the axis 20 and is designed to receive and anchor a fastener such as a self-threading sheet metal screw, in the axial direction 20. The fastener anchorage member 34 is an annular cylinder connected along one side 64 to the inner surface 36 of the lower body member 14, and has a longitudinal slot 66 in the surface thereof to enable expansion when a fastener such as the screw is inserted into the recess 38 in the longitudinal direction 20. In this manner, a threaded fastener 40 may be axially anchored therein. A similar fastener anchorage member 34' is disposed along the inner surface of the upper body member 13, parallel with the axis 20. The upper body member 13 has first and second fasteners 9 and 9' which join with third and fourth fasteners 11 and 11', respectively, on the lower body member 14, to form a unitary pipe structure which may be used for the horizontal pipe railing 4 or vertical post 2. The fastener anchorage members 34 and 34' provide a low cost structure to enable a first segment of the pipe structure such as the vertical post 2 to be fastened perpendicularly to a second segment of the pipe structure such as the horizontal top railing 4 without the need for costly joining techniques such as welding.

Figure 4:
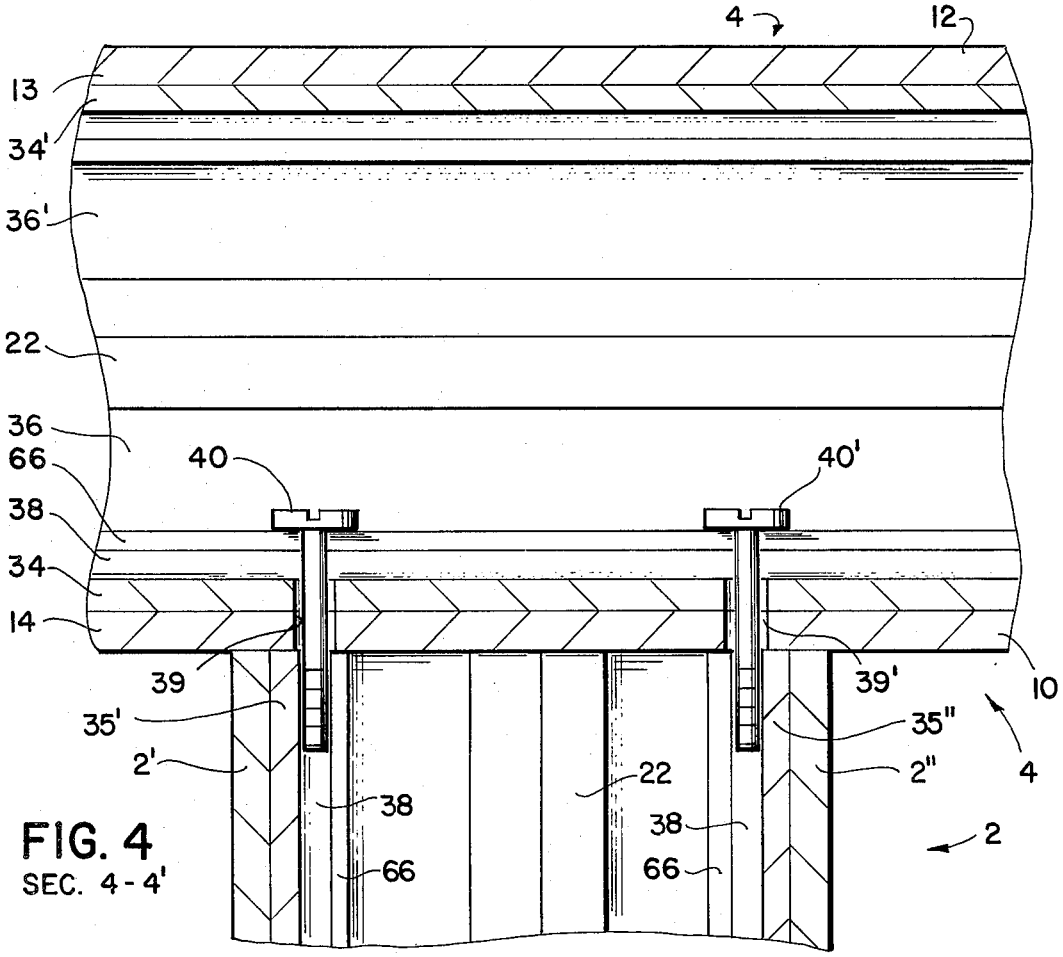
FIG. 4 is a cross-section along the section lines 4—4' of FIG. 3.

The mounting of the horizontal top railing 4 to the vertical post 2 is shown to better advantage in the cross-sectional view of FIG. 4. The vertical post 2, which is made up of the two half-cylindrical members 2' and 2'' which are identical to the members 10 and 12 shown in FIG. 3, are mechanically snapped together as will be later described. Lower horizontal pipes 5 and 7, shown in FIG. 1, which may be conventional one-piece pipe or may be the pipe railing structure disclosed herein, can be joined to respective vertical post halves 2' and 2'' prior to installation, if desired. Then, the lower half member 10 of the top horizontal pipe railing 4 has two holes 39 and 39' drilled transversely through the anchorage member 34 and side wall 14 of the lower member 10 so as to be aligned with the recesses 38 of the fastener anchorage members 35' and 35'', identical to members 34 and 34' of FIG. 3, disposed along the interior surfaces of the half-cylindrical body members 2' and 2'', respectively. The lower half-cylindrical body member 14 for the top horizontal hand rail 4 is then positioned on the upper end of the vertical post 2 so that the holes 39 and 39' are aligned with the fastener anchorage members 35' and 35'' and then the self-threading sheet metal screws 40 and 40' are driven through the holes and into the recesses 38 of the fastener anchorage members 35' and 35''. In this manner, the lower half-cylindrical member 14 of the horizontal top rail 4 is securely mounted to the vertical post 2. The next step is mechanically snapping into place the upper half-cylindrical member 12 for the top horizontal hand rail 4, as will be next described. In this manner, the pipe railing system has been assembled in a relatively simple manner without the need for welding or industrial adhesives.

Another aspect of the invention is the unique fastening mechanism for joining the two half-cylindrical body portions 13 and 14, into a unitary pipe railing structure. Two embodiments of this fastening mechanism are disclosed, the first in FIG. 3 and the second in FIG. 5.

FIG. 3 shows a first embodiment of the invention wherein the lower half 10 of the pipe railing structure 4 is not identical with the upper half 12 thereof. The upper half 12 has a first fastener 9 along the first terminal edge 16 of the upper half-cylindrical, hollow body member 13 and a second fastener 9' along the second terminal edge 18 thereof, each of which has a male fastening contour 28. In contrast, the lower half 10 has a third fastener 11 along the first terminal edge 16' of the lower half-cylindrical, hollow body member 14 and a fourth fastener 11' along the second terminal edge 18' thereof, each of which has a female fastening contour 22.

FIG. 5 shows a second embodiment of the invention wherein the lower half 10 of the pipe railing structure 4 is identical with the upper half 12 thereof. The upper half 12 has a first fastener 9 along the first terminal edge 16 of the upper half-cylindrical, hollow body member 13 which has the male fastening contour 28 and a second fastener 9' along the second terminal edge 18 thereof which has the female fastening contour 22. The lower half 10 is identical in structure to the upper half 12, having a third fastener 11 along the first terminal edge 16' of the lower half-cylindrical, hollow body member 14 with a female fastening contour 22 and a fourth fastener 11' along the second terminal edge 18' thereof with a male fastening contour 28.

The structure and operation of the male fastening contour 28 and female fastening contour 22 will be discussed with reference to the first embodiment of FIG. 3. It is convenient for explanation to define a reference plane 42 as passing through the terminal edges 16 and 18 of the upper body member 13 and the terminal edges 16' and 18' of the lower body member 14, for the pipe railing structure in its joined state as shown in FIG. 3.

The first fastener 9 for the upper body member 13 of FIG. 3 is the male fastening contour 28. The male contour 28 formed on the first terminal edge 16, has a first planar surface 27 which is approximately parallel with the reference plane 42, extending from the inner surface 36' of the upper body member 13 from which it depends. The male contour 28 has a second planar surface 29 intersecting the first planar surface 27 at an acute angle of approximately 45°, forming an edge 33 parallel with the axis 20. The male contour 28 has a third planar surface 31 which intersects the second planar surface 29 at approximately a right angle. The third surface 31 passes through a line approximately coincident with the terminal edge 16 of the cylindrical body member 13 from which it depends.

The second fastener 9' for the upper body member 13 of FIG. 3, is a male fastening contour 28 identical to that described above for the first fastener 9, but formed on the second terminal edge 18 of the upper body 13.

The third fastener 11 for the lower body member 14 of FIG. 3 is the female fastening contour 22. The female contour 22 formed on the first terminal edge 16', has a first cantilever beam portion 37 extending from the inner surface 36 of the cylindrical body member 14 from which it depends at an angle of approximately 45°. The first cantilever beam 37 terminates in a segment 41 which is approximately perpendicular to the reference plane 42. The female contour 22 has a second cantilever beam 43 which extends from the segment 41 in a direction approximately parallel with the reference plane 42, toward the terminal edge 16' of the lower body member 14. The second cantilever beam 43 terminates in a second planar surface 45 which is approximately 45° from the reference plane 42 and is approximately parallel with the second planar surface 29 of the male fastening contour 28 for the first fastener 9. A small planar segment 47 at the terminal edge 16' of the lower body member 14 is approximately coplanar with the second planar surface 45. A third planar surface 53 of the female contour 22 intersects the small planar segment 47 at approximately a right angle and extends toward the first cantilever beam 37, intersecting it at approximately a right angle. The third planar surface 53, the first cantilever beam 37, the beam segment 41, and the second cantiliever beam 43 form a longitudinal cavity 55 having an opening 49 therein, through the plane formed by the surfaces 45 and 47. The third planar surface 53 of the female contour 22 of fastener 11 is approximately parallel with the third planar surface 31 of the male contour 28 of fastener 9. The second cantilever beam 43 of the female contour 22 of fastener 11 has an inwardly facing first planar surface 51 which is approximately parallel with the first planar surface 27 of the male contour 28 of fastener 9. The first and third planar surfaces 51 and 53, respectively, of the female contour 22 terminate at the opening 49 of the cavity 55 thereof.

The fourth fastener 11' for the lower body member 14 of FIG. 3, is a female fastening contour 22 identical to that described above for the third fastener 11, but formed on the second terminal edge 18' of the lower body 14. The fourth fastener 11' in FIG. 3 bears in relationship to the second fastener 9' on the upper body 13, as does the third fastener 11 in FIG. 3 bear in its relationship to the first fastener 9, as has been discussed above.

The operation of joining the upper body 13 to the lower body 14 as shown in FIG. 3 is carried out by pressing the upper body 13 against the lower body 14 in a direction perpendicular to the reference plane 42. This forces the second surface 29 of the male contour 28 for each of the first fastener 9 and the second fastener 9', to respectively contact and slide along the respective second surface 45 of the respective female contour 22 for each of the third fastener 11 and fourth fastener 11'. This sliding action forces the first and second terminal edges 16 and 18 of the upper body 13 to separate as the upper body 13 bends outwardly. At the same time, the force of the second surface 29 of the male contour 28 against the second surface 45 of the female contour 22, bends the first cantilever beam 37, segment 41 and the second cantilever beam 43 of the female contour 22 to enlarge the opening 49 of the cavity 55 for both the third fastener 11 and fourth fastener 11'. This enables the edge 33 of the male contour 28 for each fastener 9 and 9' to enter the respective cavities 55 through the respective openings 49 of the respective fasteners 11 and 11'. The spring force of the first and second cantilever beams 37 and 43 then causes the first and third surfaces 51 and 53 of the female contour 22 to snap shut, respectively clamping the first and third surfaces 27 and 31 of the male contour 28 for both the first and third fasteners 9 and 11 and for the second and fourth fasteners 9' and 11', respectively.

The resulting joinder of the upper body 13 with the lower body 14 results in a strong joint having a smooth external appearance, achieved without the need for complex and costly installation processes.

As was mentioned above, the second embodiment of the invention shown in FIG. 5 employs the identical male fastening contour 28 and female fastening contour 22 as was discussed with reference to the embodiment shown in FIG. 3. The difference of the second embodiment of FIG. 5 over that of FIG. 3 is that both the upper half structure 12 and the lower half structure 10 are identical, thereby conferring the additional advantage of requiring the manufacture of only a single type part. The operation of joining the upper half structure 12 to the lower half structure 10 of the second embodiment of FIG. 5 differs slightly from that described above for the first embodiment of FIG. 3. In the embodiment of FIG. 5, the female contour 22 of the second fastener 9' should have its cavity 55 fitted over the edge 33 of male contour 28 of the fourth fastener 11', prior to pressing the upper body 13 toward the lower body 14 in a direction approximately perpendicular to the reference plane 42. Then the pressure induced contact and sliding action of the second surface 29 of the male contour for the first fastener 9 against the second surface 45 of the female contour 22 of the third fastener 11 of FIG. 5, imparts a similar bending action to the upper body 13 and cantilever beams 37 and 43 of the fastener 11 as was described above for the embodiment of FIG. 3. The resulting joinder of the upper body 13 with the lower body 14 results in a strong joint having a smooth external appearance.

Each half-cylindrical pipe railing structure such as 10, shown in FIG. 3 or in FIG. 5, may be an integrally formed, extruded unit with cylindrical symmetry along the axis 20. In particular, the body members shown in FIG. 3 and FIG. 5 have a circular transverse contour 14. By extruding the half-cylindrical member 10 of the second embodiment of FIG. 5 all in one unit, with the male member 28, female member 22, and fastener anchorage member 34 being an integral part of the cylindrical body member 14, the entire assembly can be produced in a single manufacturing step of extrusion. Since only one type of part, namely the extruded half-cylindrical member 10, is required to construct the improved pipe railing system shown in FIG. 5, the manufacturing cost for the system is a minimum.

The pipe railing structure may be composed of a material which has the necessary structural properties and yet which is amenable to extrusion. Suitable materials can include aluminum alloys, stainless steel alloys and various types of structural plastics such as polyvinyl chloride and acrylonitrilebutadiene styrene.

Although specific structural embodiments of the invention have been disclosed, persons of skill in the art would agree that minor changes can be made in the details of the structure, fabrication, composition and method of installation in the embodiments disclosed, without departing from the spirit and the scope of the invention.

What is claimed is:

1. An improved pipe railing structure, comprising:

a first half-cylindrical, hollow body member having first and second terminal edges parallel with a cylindrical axis;

a first fastening member disposed along said first terminal edge of said body member, having a first fastening contour;

a second fastening member disposed along said second terminal edge of said body member, having a second fastening contour;

a first fastener anchorage member disposed along an inner surface of said body member, having a longitudinal recess therein parallel with said axis, for receiving and anchoring a fastener in said axial direction;

said first fastener anchorage member further comprising:

an annular cylinder connected along one side to said inner surface of said first body member, having a longitudinal slot in the surface thereof to enable a threaded fastener to be axially anchored therein;

the structure further comprising:

a second half-cylindrical, hollow body member having first and second terminal edges parallel with said cylindrical axis;

a third fastening member disposed along said first terminal edge of said second body member, having a third fastening contour complementary to said first fastening contour of said first fastening member on said first body member;

a fourth fastening member disposed along said second terminal edge of said second body member, having a fourth fastening contour complementary to said second fastening contour of said second fastening member on said first body member;

a second fastener anchorage member disposed along an inner surface of said second body member, having a longitudinal recess therein parallel with said axis, for receiving and anchoring a fastener in said axial direction;

said first and third fastening members joining along their respective, complementary contours and said second and fourth fastening members joining along their respective, complementary contours to thereby join said first and second body members to form a unitary, cylindrical pipe railing;

said second fastener anchorage member further comprising:

an annular cylinder connected along one side to said inner surface of said second body member, having a longitudinal slot in the surface thereof to enable a threaded fastener to be axially anchored therein;

said first fastening contour of said first fastening member and said second fastening contour of said second fastening member being a male fastening contour;

said third fastening contour of said third fastening member and said fourth fastening contour of said fourth fastening member being a female fastening contour;

said first and second terminal edges of said first body member defining a reference plane;

said male fastening contour having a first planar surface approximately parallel with said reference plane, extending from said inner surface of said cylindrical body member from which it depends, a second planar surface intersecting said first planar surface at an acute angle forming an edge parallel with said axis, and a third planar surface intersecting said second planar surface at approximately a right angle and coincident with said terminal edge of said cylindrical body member from which it depends;

said female fastening contour having a first cantilever portion extending from said inner surface of said cylindrical body member from which it depends and terminating in a segment approximately perpendicular to said reference plane, a second cantilever portion extending from said segment and terminating in a second planar surface approximately parallel with said second planar surface of said male fastening contour, said first cantilever portion, said inner surface from which it depends, and said second cantilever portion forming a cavity with said body member inner surface therein forming a third planar surface approximately parallel with said third planar surface of said male fastening contour and said second cantilever portion having an inwardly facing first planar surface approximately parallel with said first planar surface of said male contour member, said first and third planar surfaces of said female fastening contour terminating in an opening for said cavity;

said male fastening contour being joined to said female fastening contour by forcing said second surface of said male contour against said second surface of said female contour thereby bending said first cantilever portion and said second cantilever portion of said female contour to enlarge said opening of said cavity to enable said edge of said male contour to enter said cavity through said opening and said first and third surfaces of said female contour to clamp against said first and third surfaces of said male contour, respectively.

2. The structure of claim 1, wherein said first and second body members are integrally formed, extruded units with cylindrical symmetry along said axis.

3. The structure of claim 2, wherein said first and second body members have a circular transverse contour.

4. The structure of claim 3, wherein said structure is composed of a material which is a member of the group consisting of stainless steel, aluminum and plastic.

5. An improved pipe railing structure, comprising:

a first half-cylindrical, hollow body member having first and second terminal edges parallel with a cylindrical axis;

a first fastening member disposed along said first terminal edge of said body member, having a first fastening contour;

a second fastening member disposed along said second terminal edge of said body member, having a second fastening contour;

a first fastener anchorage member disposed along an inner surface of said body member, having a longitudinal recess therein parallel with said axis, for receiving and anchoring a fastener in said axial direction;

said first fastener anchorage member further comprising:

an annular cylinder connected along one side to said inner surface of said first body member, having a longitudinal slot in the surface thereof to enable a threaded fastener to be axially anchored therein;

the structure further comprising:

a second half-cylindrical, hollow body member having first and second terminal edges parallel with said cylindrical axis;

a third fastening member disposed along said first terminal edge of said second body member, having a third fastening contour complementary to said first fastening contour of said first fastening member on said first body member;

a fourth fastening member disposed along said second terminal edge of said second body member, having a fourth fastening contour complementary to said second fastening contour of said second fastening member on said first body member;

a second fastener anchorage member disposed along an inner surface of said second body member, having a longitudinal recess therein parallel with said axis, for receiving and anchoring a fastener in said axial direction;

said first and third fastening members joining along their respective, complementary contours and said second and fourth fastening members joining along their respective, complementary contours to thereby join said first and second body members to form a unitary, cylindrical pipe railing;

said second fastener anchorage member further comprising:

an annular cylinder connected along one side to said inner surface of said second body member, having a longitudinal slot in the surface thereof to enable a threaded fastener to be axially anchored therein;

said first fastening contour of said first fastening member and said fourth fastening contour of said fourth fastening member being a male fastening contour;

said second fastening contour of said second fastening member and said third fastening contour of said third fastening member being a female fastening contour;

said first and second terminal edges of said first body member defining a reference plane;

said male fastening contour having a first planar surface approximately parallel with said reference plane, extending from said inner surface of said cylindrical body member from which it depends, a second planar surface intersecting said first planar surface at an acute angle forming an edge parallel with said axis, and a third planar surface intersecting said second planar surface at approximately a right angle and coincident with said terminal edge of said cylindrical body member from which it depends;

said female fastening contour having a first cantilever portion extending from said inner surface of said cylindrical body member from which it depends and terminating in a segment approximately perpendicular to said reference plane, a second cantilever portion extending from said segment and terminating in a second planar surface approximately parallel with said second planar surface of said male fastening contour, said first cantilever portion, said inner surface from which it depends, and said second cantilever portion forming a cavity with said body member inner surface therein forming a third planar surface approximately parallel with said third planar surface of said male fastening contour and said second cantilever portion having an inwardly facing first planar surface approximately parallel with said first planar surface of said male contour member, said first and third planar surfaces of said female fastening contour terminating in an opening for said cavity;

said male fastening contour being joined to said female fastening contour by forcing said second surface of said male contour against said second surface of said female contour thereby bending said first cantilever portion and said second cantilever portion of said female contour to enlarge said opening of said cavity to enable said edge of said male contour to enter said cavity through said opening and said first and third surfaces of said female contour to clamp against said first and third surfaces of said male contour, respectively.

6. The structure of claim 5, wherein said first and second body members are integrally formed, extruded units with cylindrical symmetry along said axis.

7. The structure of claim 6, wherein said first and second body members have a circular transverse contour.

8. The structure of claim 7, wherein said structure is composed of a material which is a member of the group consisting of stainless steel, aluminum and plastic.

9. An improved pipe railing structure, comprising:

a first half-cylindrical, hollow body member having first and second terminal edges parallel with a cylindrical axis;

a first fastening member disposed along said first terminal edge of said body member, having a first fastening contour;

a second fastening member disposed along said second terminal edge of said body member, having a second fastening contour;

a first fastener anchorage member disposed along an inner surface of said body member, having a longitudinal recess therein parallel with said axis, for receiving and anchoring a fastener in said axial direction;

a second half-cylindrical, hollow body member having first and second terminal edges parallel with said cylindrical axis;

a third fastening member disposed along said first terminal edge of said second body member, having a third fastening contour complementary to said first fastening contour of said first fastening member on said first body member;

a fourth fastening member disposed along said second terminal edge of said second body member, having a fourth fastening contour complementary to said second fastening contour of said second fastening member on said first body member;

a second fastener anchorage member disposed along an inner surface of said second body member, having a longitudinal recess therein parallel with said axis, for receiving and anchoring a fastener in said axial direction;

said first and third fastening members joining along their respective, complementary contours and said second and fourth fastening members joining along their respective, complmentary contours to thereby join said first and second body members to form a unitary, cylindrical pipe railing;

said first fastening contour of said first fastening member and said second fastening contour of said second fastening member being a male fastening contour;

said third fastening contour of said third fastening member and said fourth fastening contour of said fourth fastening member being a female fastening contour;

said first and second terminal edges of said first body member defining a reference plane;

said male fastening contour having a first planar surface approximately parallel with said reference plane, extending from said inner surface of said cylindrical body member from which it depends, a second planar surface intersecting said first planar surface at an acute angle forming an edge parallel with said axis, and a third planar surface intersecting said second planar surface at approximately a right angle and coincident with said terminal edge of said cylindrical body member from which it depends;

said female fastening contour having a first cantilever portion extending from said inner surface of said cylindrical body member from which it depends and terminating in a segment approximately perpendicular to said reference plane, a second cantilever portion extending from said segment and terminating in a second planar surface approximately parallel with said second planar surface of said male fastening contour, said first cantilever portion, said inner surface from which it depends, and said second cantilever portion forming a cavity with said body member inner surface therein forming a third planar surface approximately parallel with said third planar surface of said male fastening contour and said second cantilever portion having an inwardly facing first planar surface approximately parallel with said first planar surface of said male contour member, said first and third planar surfaces of said female fastening contour terminating in an opening for said cavity;

said male fastening contour being joined to said female fastening contour by forcing said second surface of said male contour against said second surface of said female contour thereby bending said first cantilever portion and said second cantilever portion of said female contour to enlarge said opening of said cavity to enable said edge of said male contour to enter said cavity through said opening and said first and third surfaces of said female contour to clamp against said first and third surfaces of said male contour, respectively.

10. An improved pipe railing structure, comprising:

a first half-cylindrical, hollow body member having first and second terminal edges parallel with a cylindrical axis;

a first fastening member disposed along said first terminal edge of said body member, having a first fastening contour;

a second fastening member disposed along said second terminal edge of said body member, having a second fastening contour;

a first fastener anchorage member disposed along an inner surface of said body member, having a longitudinal recess therein parallel with said axis, for receiving and anchoring a fastener in said axial direction;

a second half-cylindrical, hollow body member having first and second terminal edges parallel with said cylindrical axis;

a third fastening member disposed along said first terminal edge of said second body member, having a third fastening contour complementary to said first fastening contour of said first fastening member on said first body member;

a fourth fastening member disposed along said second terminal edge of said second body member, having a fourth fastening contour complementary to said second fastening contour of said second fastening member on said first body member;

a second fastener anchorage member disposed along an inner surface of said second body member, having a longitudinal recess therein parallel with said axis, for receiving and anchoring a fastener in said axial direction;

said first and third fastening members joining along their respective, complementary contours and said second and fourth fastening members joining along their respective, complementary controus to thereby join said first and second body members to form a unitary, cylindrical pipe railing;

said first fastening contour of said first fastening member and said fourth fastening contour of said fourth fastening member being a male fastening contour;

said second fastening contour of said second fastening member and said third fastening contour of said third fastening member being a female fastening contour;

said first and second terminal edges of said first body member defining a reference plane;

said male fastening contour having a first planar surface approximately parallel with said reference plane, extending from said inner surface of said cylindrical body member from which it depends, a second planar surface intersecting said first planar surface at an acute angle forming an edge parallel with said axis, and a third planar surface intersecting said second planar surface at approximately a right angle and coincident with said terminal edge of said cylindrical body member from which it depends;

said female fastening contour having a first cantilever portion extending from said inner surface of said cylindrical body member from which it depends and terminating in a segment approximately perpendicular to said reference plane, a second cantilever portion extending from said segment and terminating in a second planar surface approximately parallel with said second planar surface of said male fastening contour, said first cantilever portion, said inner surface from which it depends, and said second cantilever portion forming a cavity with said body member inner surface therein forming a third planar surface approximately parallel with said third planar surface of said male fastening contour and said second cantilever portion having an inwardly facing first planar surface approximately parallel with said first planar surface of said male contour member, said first and third planar surfaces of said female fastening contour terminating in an opening for said cavity;

said male fastening contour being joined to said female fastening contour by forcing said second surface of said male contour against said second surface of said female contour thereby bending said first cantilever portion and said second cantilever portion of said female contour to enlarge said opening of said cavity to enable said edge of said male contour to enter said cavity through said opening and said first and third surfaces of said female contour to clamp against said first and third surfaces of said male contour, respectively.

* * * * *